US007530299B1

(12) United States Patent
Poff

(10) Patent No.: US 7,530,299 B1
(45) Date of Patent: May 12, 2009

(54) FIREARM MUZZLE BRAKE

(76) Inventor: Charles Poff, P.O. Box 560694, Melbourne, FL (US) 32956

( * ) Notice: Subject to any disclaimer, the term of this patent is extended or adjusted under 35 U.S.C. 154(b) by 342 days.

(21) Appl. No.: 11/487,531

(22) Filed: Jul. 14, 2006

Related U.S. Application Data

(60) Provisional application No. 60/699,239, filed on Jul. 14, 2005.

(51) Int. Cl.
*F41A 21/34* (2006.01)
*F41A 21/36* (2006.01)

(52) U.S. Cl. ..... 89/14.3; 89/198; 42/1.06

(58) Field of Classification Search ..... 89/14.3, 89/198, 36.01, 36.02, 36.03, 36.04, 36.07, 89/36.08, 36.09, 36.12, 36.17; 42/1.06, 79
See application file for complete search history.

(56) References Cited

U.S. PATENT DOCUMENTS

| | | | | | |
|---|---|---|---|---|---|
| 1,327,897 | A * | 1/1920 | Baldwin | 89/125 |
| 4,242,961 | A * | 1/1981 | Moredock et al. | 102/527 |
| 4,392,413 | A * | 7/1983 | Gwinn, Jr. | 89/14.3 |
| D281,895 | S * | 12/1985 | McLain | D22/108 |
| 4,879,942 | A * | 11/1989 | Cave | 89/14.3 |
| 5,385,079 | A * | 1/1995 | Cave | 89/14.3 |
| 5,652,406 | A | 7/1997 | Plan | |
| 5,794,374 | A * | 8/1998 | Crandall | 42/97 |
| 6,216,578 | B1 * | 4/2001 | Ledys et al. | 89/14.3 |
| 6,276,251 | B1 * | 8/2001 | Downing et al. | 89/14.3 |
| 6,516,698 | B1 | 2/2003 | Poff | |
| 6,578,462 | B1 * | 6/2003 | Franchino et al. | 89/14.3 |
| 6,820,530 | B2 * | 11/2004 | Vais | 89/14.3 |
| 7,032,339 | B1 * | 4/2006 | Bounds | 42/1.06 |
| 7,143,680 | B2 * | 12/2006 | Bender | 89/14.3 |
| 7,296,505 | B2 * | 11/2007 | Balbo et al. | 89/14.3 |
| 2003/0106417 | A1 * | 6/2003 | Vais | 89/14.3 |
| 2004/0244571 | A1 * | 12/2004 | Bender | 89/14.3 |
| 2005/0252365 | A1 * | 11/2005 | Balbo et al. | 89/14.3 |

* cited by examiner

*Primary Examiner*—Bret Hayes
(74) *Attorney, Agent, or Firm*—Malin Haley DiMaggio Bowen & Lhota, P.A.

(57) ABSTRACT

A muzzle brake includes three primary structural components, namely a main body, a baffle, and an end cap. The components are preferably integrally fabricated into a single piece device, or alternatively may be fabricated separately and assembled. A muzzle brake in accordance with the present invention comprises a generally cylindrical muzzle brake assembly attachable to the muzzle end of a firearm. The muzzle brake assembly forms two expansion chambers, each of which is bounded by a peripheral sidewall defining opposing left and right vent apertures and a converging end wall. The end walls define axially aligned openings sized slightly larger than the diameter of the projectile for allowing the projectile to pass from the firearm muzzle, through the muzzle brake, and onward down the target line toward the intended target. The first chamber defines opposing left and right vent apertures for venting gases generally upward and rearward to reduce muzzle jump. The second chamber defines opposing left and right side apertures, with the left aperture being substantially larger than the right aperture for venting gases to counter torque related movement.

6 Claims, 3 Drawing Sheets

FIREARM MUZZLE BRAKE

CROSS REFERENCE TO RELATED APPLICATIONS

This application claims the benefit of provisional U.S. Patent Application Ser. No. 60/699,239, filed Jul. 14, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all rights whatsoever including copyrights.

BACKGROUND OF THE INVENTION

1. Field of the Invention

The present invention relates to firearms and weapons, and, more particularly to firearms and weapons adapted to vent gases for reducing muzzle jump upon firing.

2. Description of the Background Art

The firing of projectiles, bullets, shot, and shells (hereinafter "projectile") from firearms and weapons (hereinafter "firearms") is an advancement that is well known in the art. The act of firing such firearms is known to result in muzzle rise, and torque induced forces resulting in substantial displacement of the weapon from the original point of aim. The reduction of these is the subject of the present invention.

Muzzle rise is an upward movement of the barrel upon firing. Muzzle rise results from the recoil force acting along the longitudinal axis of the barrel, which axis is typically above the point of resistance supporting the weapon. For example, a shoulder-fired weapon, such as a rifle or shotgun, has a point of resistance—other than the resistance presented by the weight of the weapon itself—where the butt of the weapon rests against the shooter's shoulder. The highest point on the butt of the weapon, namely the heel, is typically one or more inches below the axis of the barrel, and hence below the level at which the recoil force acts. The spacing between the heel and the uppermost exterior portion of the barrel, including what is referred to as the rib, is a term of art referred to as the amount of drop at the heel. As a result of the drop at the heel, the recoil force vector acts above the point of resistance thereby resulting in a moment force that causes the barrel to pivot upward.

Similarly, in the case of a hand-held weapon such as a pistol, the uppermost portion of the grip or the main bearing portion of the hand upon the rear of the grip is below the level of the barrel. Since the barrel axis represents the recoil force vector, muzzle jump is also experienced with handguns.

In addition, the rifling of the firearm barrel and resulting spin imparted on the bullet result in torque that also can cause the firearm to jump sideways.

Movement of the muzzle is undesirable for a number of reasons. For example, in anticipation muzzle rise shooters have been known to flinch, resulting in an uncontrollable momentary closing of the eye, which flinching is a cause of poor aim. Furthermore, physically resisting muzzle rise tends to fatigue the shooter and inhibits the shooter's ability to fire a large number of projectiles, particularly in rapid succession. In addition, the reduction of muzzle rise and movement will enable the use of larger mass projectiles. Accordingly, the reduction of muzzle rise and movement enhances the shooter's ability to rapidly and accurately return the firearm to a properly aimed position.

The reduction of muzzle rise is particularly desirable in other applications, such as those applications involving large caliber weapons. Specifically, the reduction of shock forces associated with muzzle rise will improve the viability and reliability of electronic and mechanical systems found in modern military firearms. The reduction of muzzle rise and torque related movement will also benefit the physical and mental well being of personnel in proximity to the firing station associated with large weapons. Finally, the reduction of muzzle rise and torque related movement will result in less fatigue and shock stress for metals and other components of the weapon thereby improving durability and dramatically increasing the accuracy of following shots.

The background art reveals several attempts directed to reducing muzzle rise. For example, it is known to provide porting for shotgun and firearm barrels to reduce recoil and muzzle rise. The porting of the barrel enables the venting of gases in an upward direction during the firing process. Venting gases in this manner generates a downward force on the barrel to stabilize the muzzle and reduce muzzle rise. A number of systems attempt to reduce muzzle rise by venting barrel gases at or near the muzzle end of the barrel. For example, U.S. Pat. No. 3,808,943, issued to Kelly, discloses a gun-leveling device that comprises a barrel having trapezoidal slots for venting muzzle gases to prevent muzzle rise. U.S. Pat. No. 4,207,799, issued to Tocco, discloses a muzzle brake for attachment to a handgun for venting gas in a generally upwardly direction to assist in maintaining the firearm stable. U.S. Pat. No. 4,392,413, issued to Gwinn, Jr., discloses a muzzle attachment for a firearm barrel. The muzzle attachment is configured to act as both a muzzle brake to reduce recoil and as a compensator to reduce upward movement of the muzzle when the firearm is fired. U.S. Pat. No. 5,243,895, issued to Dickman et al., discloses a gun barrel defining trapezoidal ports positioned on radials between fifteen and twenty-five degrees from the upper centerline of the barrel to prevent muzzle jump. U.S. Pat. No. 5,587,549, issued to Clouse, discloses a barrel porting system comprising a barrel adapted to define a pair of rows of spaced apart venting orifices extending through the barrel to vent exhaust gases. The venting orifices are configured to vent gases both upwardly and rearwardly, so that resultant vector forces generated by the escaping gases are translated into downwardly and forwardly directed components to reduce muzzle rise and recoil. U.S. Pat. No. 6,269,727, issued to Nigge, discloses a muzzle mounted attachment that deflects combustion gases after leaving the barrel.

While the muzzle mounted attachments disclosed in the art may have proven somewhat effective in reducing muzzle jump none appear to adequately reduce muzzle jump and torque related movement. Thus, there exists a need for improvements in the field of firearms and weapons to reduce muzzle jump and torque related movement that overcomes the problems and disadvantages present in the background art.

BRIEF SUMMARY OF THE INVENTION

The present invention overcomes the disadvantages present in the art by providing an improved muzzle brake. A muzzle brake in accordance with the present invention includes three primary structural components, namely a main body, a baffle, and an end cap. The components are preferably integrally fabricated into a single piece device, or alternatively may be fabricated separately and assembled. A muzzle brake in accordance with the present invention comprises a generally cylindrical muzzle brake assembly attachable to the muzzle end of a firearm. The muzzle brake assembly forms two expansion chambers, each of which is bounded by a peripheral side wall defining opposing left and right vent apertures and a converging end wall. The end walls define axially aligned openings sized slightly larger than the diameter of the projectile for allowing the projectile to pass from the firearm muzzle, through the muzzle brake, and onward down the target line toward the intended target.

The muzzle brake of the present invention is effective in vertically directing gasses so as to depress the muzzle thereby counteracting muzzle jump, reducing normal recoil forces, and compensating from projectile induced torque thereby assisting in maintaining the weapon on target. The muzzle brake is further lightweight, readily adapted to various weapons systems and calibers, short in length so as to avoid adversely effecting the weapons accuracy and maneuverability, and of simple one piece design. In addition, the muzzle brake reduces visible flash and eliminates ground footprint as gases are generally directed vertically away from the shooter.

Accordingly, it is an object of the present invention to provide a muzzle brake for firearms that reduces recoil and counters projectile induced torque.

Another object of the present invention is to provide a muzzle brake for firearms that is further effective in suppressing muzzle flash.

Still these and other objects will be disclosed and/or become apparent in view of the detailed description and drawings.

DETAILED DESCRIPTION OF THE INVENTION

With reference now to the drawings, FIGS. 1-6 depict a muzzle brake 10 in accordance with the present invention. Muzzle brake 10 mounts on the firearm shown in phantom in FIG. 1 using the existing firearm's existing barrel muzzle threads, and may replace existing brakes or flash suppressors. Muzzle brake 10 is preferably fabricated from a suitable gunmetal material or alloy.

Figure 6:
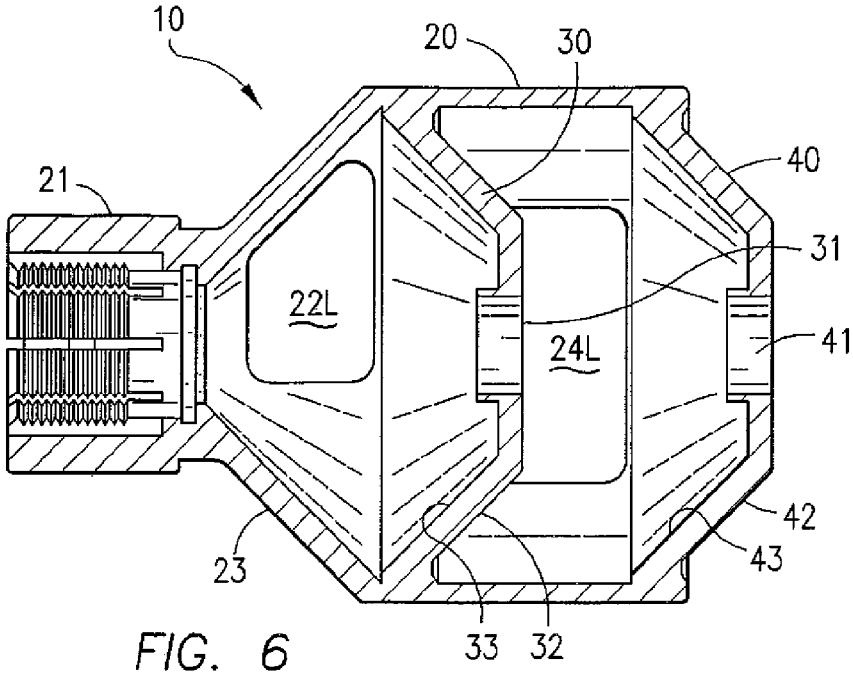
FIG. 6 is a sectional view thereof taken along line 6-6 of FIG. 5.

Muzzle brake 10 includes of three primary structural components, namely a main body 20, an internal baffle 30, and an end cap 40. Main body 20 has a mounting end 21 adapted for secured attachment to the end of the firearm barrel, either by threaded connection, or any other suitable connection method or structure. Internal baffle 30 and end cap 40 are shaped as generally identical truncated conical members. Internal baffle 30 defines a projectile aperture 31 and includes forward facing and rearward facing surfaces, referenced as 32 and 33 respectively. End cap 40 defines a projectile aperture 41, and includes forward and rearward facing surfaces, referenced as 42 and 43 respectively. In embodiments wherein the muzzle brake is fabricated from separate assembled components, internal baffle 30 and end cap 40 may be adapted with externally threaded peripheral edges for mating threaded engagement with internally threaded portions of main body 20. As best depicted in FIG. 6, internal baffle 30 and end cap 40 divide the main body interior into two cylindrical expansion chambers with approximately equal volumes connected by an opening that is slightly larger in diameter than the projectile. More particularly, a rear or high-pressure chamber is defined by the interior of main body 20 and baffle 30, and a front or low pressure chamber is defined by the interior of main body 20 in the volume defined between baffle 30 and end cap 40.

Figure 1:
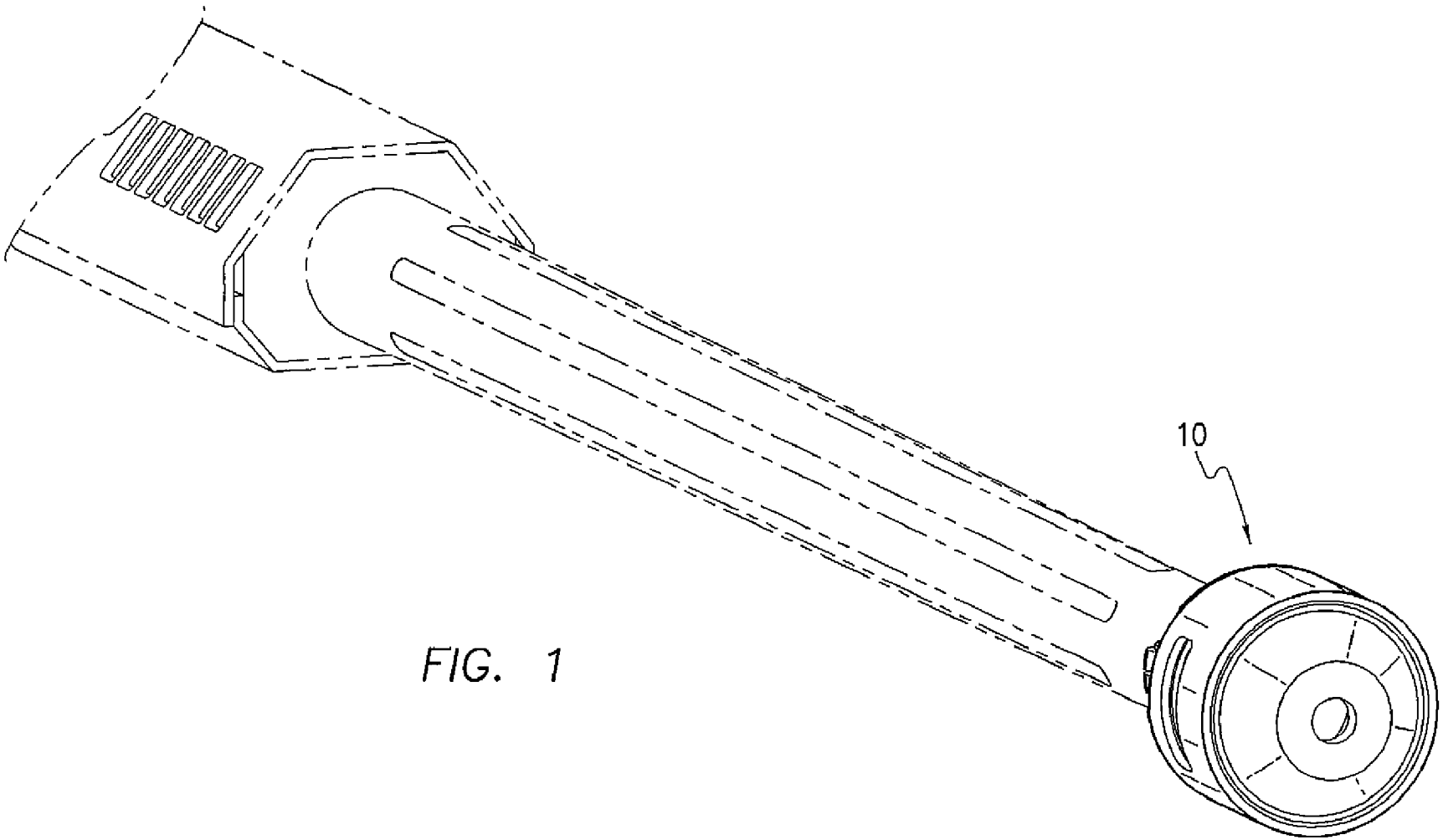
FIG. 1 is a partial perspective view of a firearm (depicted in phantom) adapted with a muzzle brake in accordance with the present invention.
Figure 2:
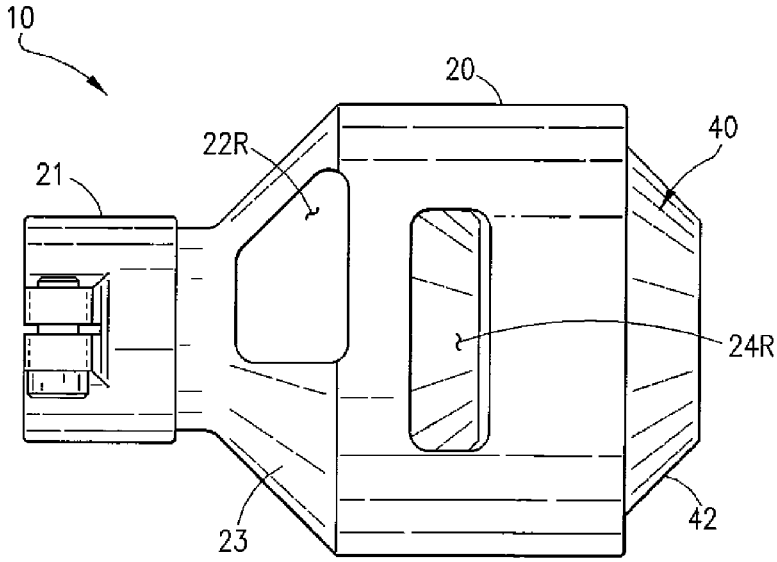
FIG. 2 is a side view of the muzzle brake.
Figure 3:
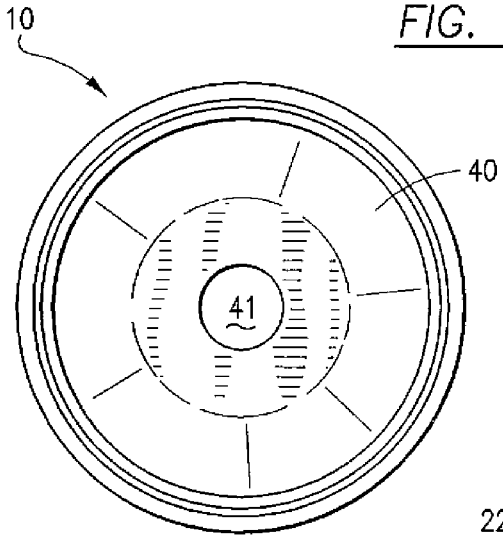
FIG. 3 is end view of the discharge end thereof.
Figure 4:
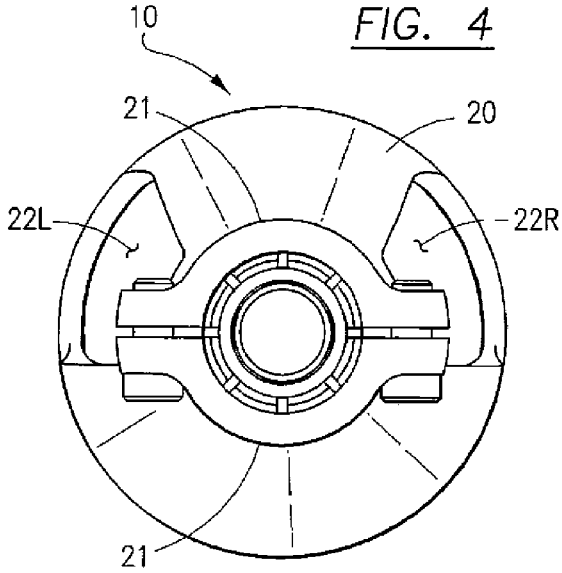
FIG. 4 is an end view of the mounting end thereof.
Figure 5:
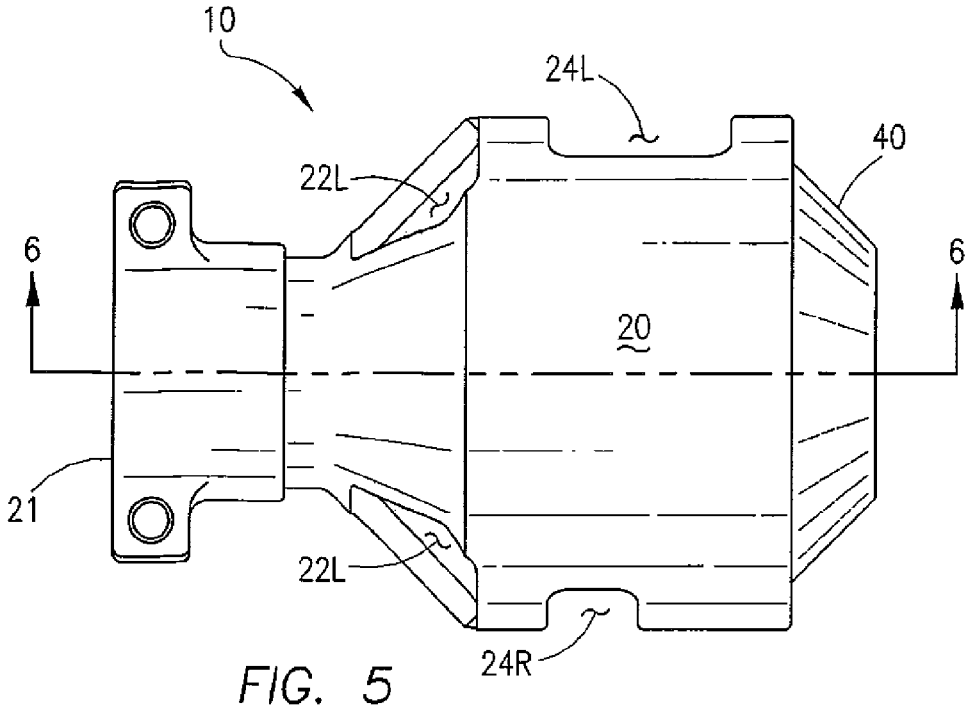
FIG. 5 is a top view thereof.

The rear high-pressure chamber has two side exit ports 22L and 22R for the venting of high pressure and velocity gasses as seen in FIGS. 2, 4, and 5. Ports 22L and 22P are formed on the rear portion of main body 20, which portion, referenced as 23, is angularly disposed relative to the barrel axis as best seen in FIG. 2. As best seen in FIGS. 2 and 4, ports 22L and 22R are located on opposite sides with approximately 80% of the area of the ports disposed above longitudinal centerline. Side exit ports 22L and 22R, thus remove approximately 50% of the rear surface area available for the gasses and gas pressure to operate against thus allowing the gas to escape thereby reducing weapon recoil. In addition, since the remaining rear surface area is angled at approximately 45-degrees relative to the centerline (projectile firing target line) of the weapon, less than 50% of the forces experienced by the rear surface are actually transferred into rear operating forces that contribute to recoil forces. This reduces the rearward force vector component of resulting recoil forces. As the gases are ejected from the barrel at a nominal velocity of 5,000 feet per second they expand and fill the rear chamber. In addition, the gases transmit energy to the entire forward inner conical surface 33 formed by baffle 30, providing a forward force vector. Due to the small diameter exit hole 31 formed in baffle 30 only very high velocity and pressure gasses exit the rear chamber via this forward port and enter the second chamber. The gasses that do not exit the first chamber are turned 180 degrees after encountering surface 33 of baffle 30, expending energy against rearwardly facing wall 33 thus countering normal recoil forces. The gasses are then forced to pass through exit ports 22L and 22R in a vertically upward path thereby resulting in a force vector that depresses the muzzle forcing the weapon to remain in contact with the firing surface, reducing felt recoil and keeping the weapon on target allowing for a faster accurately aimed shot. After exiting the rear chamber, the projectile, riding in a high-pressure stream of propellant and gasses passes into the forward chamber. Approximately 25 percent of all the energies experienced in the rear chamber are added to the rearward force vector, while slightly over 75 percent are converted to forward and downward force vectors.

The forward chamber comprises an area defined by the cylindrical wall of main body 20, the forwardly facing surface 32 of baffle 30 and the rearwardly facing surface 43 of end cap 40. The forward chamber is typically at atmospheric pressure and allows the entering stream of gasses and un-burnt propellant to expend energy on the rearwardly facing surface 43 of end cap 40. As the projectile exits via the center passage 41 formed in end cap 40, it plugs this passage requiring the trapped gases to strike the rearwardly facing surface 43 of end cap 40 and be deflected in an opposite direction then exit whereby the gases exit the two side ports, referenced as 24L and 24R.

As is well known in the art, firearm barrels are internally rifled. The rifling causes the projectile to rotate about its longitudinal axis. As a result, torque is produced by the acceleration of the projectile and gasses from a position of rest to a velocity of approximately 3,000 feet per second with a rotational velocity along the projectile's centerline of approximately 180,000 revolutions per minute. Accordingly, exit ports 24L and 24R are preferably configured to force the majority of the gasses to exit the break on the side that will counter or offset the induced torque forces. Thus, in a conventionally rifled firearm exit port 24L is substantially larger than exit port 24R as best seen in FIG. 5. As best seen in FIG. 2, exit ports 24L and 24R are formed along the centerline and/or projectile target line so as to produce lateral thrust forces that are generally horizontal when the firearm and muzzle brake 10 are horizontally disposed. This aids significantly in keeping the weapon on target allowing for rapid accurately aimed repeat shots.

The instant invention has been shown and described herein in what is considered to be the most practical and preferred embodiment. It is recognized, however, that departures may be made therefrom within the scope of the invention and that obvious modifications will occur to a person skilled in the art.

I claim:

1. A muzzle brake for firearms comprising:

a generally hollow body formed about a longitudinal axis, said body having a first end adapted for connection to a firearm and a second end;

an internal baffle contained within said body and disposed between sand first end and said second end, said internal baffle defining an axial aperture and a wall extending radially outward from said aperture to said body, said wall having at least a portion thereof angularly disposed relative to said axis;

an end cap connected to said body second end, said end cap defining an axial aperture and a wall extending radially outward from said aperture to said body, said wall having at least a portion thereof angularly disposed relative to said axis;

said body defining a first set of opposing left and right apertures defined between said first end and said internal baffle; and said body defining a second set of opposing left and right apertures defined between said internal baffle and said end cap, and wherein said second left aperture is larger than said second right aperture.

2. A muzzle brake according to claim 1, wherein said angularly disposed portion of said internal baffle wall defines an acute angle relative to said axis.

3. A muzzle brake according to claim 1, wherein said angularly disposed portion of said end cap wall defines an acute angle relative to said axis.

4. A muzzle brake according to claim 1, wherein said first set of opposing left and right apertures defined between said first end and said internal baffle are defined within an angularly disposed portion of said main body.

5. A muzzle brake for firearms comprising:

a generally hollow body formed about a longitudinal axis, said body having a first end adapted for connection to a firearm, a second end, and a peripheral wall connecting said first and second end;

an internal baffle contained within said body and disposed between sand first end and said second end so as to define a first chamber, said internal baffle defining an axial aperture and a wall extending radially outward from said aperture to said body peripheral wall thereby defining a first chamber, said baffle wall having a rearwardly facing surface having at least a portion thereof angularly disposed relative to said axis so as to from an acute angle relative thereto;

an end cap connected to said body second end, said end cap defining an axial aperture and a wall extending radially outward from said aperture to said body peripheral wall thereby defining a second chamber, said end cap wall having a rearwardly facing surface having at least a portion thereof angularly disposed relative to said axis so as to form an acute angle relative thereto;

said body defining a first set of opposing left and right apertures defined between said first end and said internal baffle for venting gases from said first chamber generally upward and rearward; and said body defining a second set of opposing left and right apertures defined between said internal baffle and said end cap for venting gases from said second chamber generally laterally relative to said axis, and wherein said second left aperture is larger than said second right aperture.

6. A muzzle brake for firearms comprising:

a generally hollow body formed about a longitudinal axis, said body having a rearward end adapted for connection to a firearm, a forward end, and a peripheral wall connecting said first and second end;

said body including an internal wall disposed between said rearward end and said forward end so as to define a first chamber, said wall defining an axial aperture and having a rearwardly facing surface extending radially outward from said axis to said peripheral body wall, said internal wall rearwardly facing surface having at least a portion thereof angularly disposed relative to said axis so as to from an acute angle relative thereto;

said body forward end having a forward end wall, said forward end wall defining an axial aperture and extending radially outward from said axis to said peripheral body wall so as to define a second chamber bounded by said body peripheral wall, said internal wall and said forward end wall, said forward end wall having a rearwardly facing surface having at least a portion thereof angularly disposed relative to said axis so as to form an acute angle relative thereto;

said body defining a first set of opposing left and right apertures defined between said first end and said internal baffle for venting gases from said first chamber generally upward and rearward; and said body defining a second set of opposing left and right apertures defined between said internal baffle and said end cap for venting gases from said second chamber generally laterally relative to said axis, and wherein said second left aperture is larger than said second right aperture.

* * * * *